US008371682B1

(12) United States Patent
Del Raso

(10) Patent No.: US 8,371,682 B1
(45) Date of Patent: Feb. 12, 2013

(54) INK REPLENISHING SYSTEM FOR INK JET PRINTERS

(76) Inventor: Americo Del Raso, Rocky River, OH (US)

( * ) Notice: Subject to any disclaimer, the term of this patent is extended or adjusted under 35 U.S.C. 154(b) by 365 days.

(21) Appl. No.: 12/687,298

(22) Filed: Jan. 14, 2010

(51) Int. Cl.
*B41J 2/17* (2006.01)
*B41J 2/175* (2006.01)
*B41J 2/18* (2006.01)

(52) U.S. Cl. ..... 347/84; 347/85; 347/89

(58) Field of Classification Search ..... 347/7, 84, 347/85, 89
See application file for complete search history.

(56) References Cited

U.S. PATENT DOCUMENTS

| | | | | |
|---|---|---|---|---|
| 5,367,328 | A | 11/1994 | Erickson | |
| 5,631,681 | A | 5/1997 | Klaus et al. | |
| 5,704,403 | A | 1/1998 | Schwenk et al. | |
| 5,880,748 | A | 3/1999 | Childers et al. | |
| 6,007,173 | A * | 12/1999 | DeLouise et al. | 347/7 |
| 6,234,615 | B1 * | 5/2001 | Tsukuda | 347/85 |
| 6,565,197 | B1 | 5/2003 | Murray et al. | |
| 6,666,552 | B2 | 12/2003 | Anderson et al. | |
| 6,785,483 | B2 | 8/2004 | Liu et al. | |
| 6,846,071 | B2 | 1/2005 | Rhee | |
| 7,089,973 | B2 | 8/2006 | Nicodem et al. | |
| 7,097,288 | B2 * | 8/2006 | Van Os et al. | 347/85 |
| 7,182,444 | B2 * | 2/2007 | Kawamoto | 347/85 |
| 7,374,272 | B2 * | 5/2008 | Seshimo et al. | 347/23 |
| 2003/0076391 | A1 * | 4/2003 | Wilson et al. | 347/86 |

* cited by examiner

*Primary Examiner* — Laura Martin
*Assistant Examiner* — Jeremy Bishop
(74) *Attorney, Agent, or Firm* — John D. Gugliotta

(57) ABSTRACT

An ink replenishing system that automatically activates the replenishment of modified ink cartridges to receive a refilling volume of ink from a larger, bulk ink source. The use of one modified tricolor cartridge and one modified black ink cartridge function as the distributors for the proper dispersion of ink. The cartridges are modified to incorporate access orifices to communicate with ink injectors when the cartridges park (or when the printer is turned off). A micro switch is tripped which, in turn, energizes an isolation relay which powers up the ink replenishing system. When the modified cartridges become low, sensing metal plates imbedded in the matrix of the modified cartridges sense little or no current flowing from one plate to the other; thus, there is insufficient current to energize an opposing coil of an electric motor pump relay and the pumping actions is continued until the cartridge is filled to capacity.

1 Claim, 4 Drawing Sheets

INK REPLENISHING SYSTEM FOR INK JET PRINTERS

RELATED APPLICATIONS

There are no previously filed, nor currently any co-pending applications, anywhere in the world.

BACKGROUND OF THE INVENTION

1. Field of the Invention

The present invention relates generally ink storage and distribution for ink jet printers and, more specifically, to a high capacity ink replenishing system for ink jet printers that the present invention relates to an automatic sensing device for use on bulk material handling devices.

2. Description of the Related Art

Ink jet printers are a type of computer printer that reproduces a digital image by propelling variably-sized droplets of liquid or molten material ink onto a page. These type of computer printers are well known and have become widely used in conjunction with personal computers for both home and much small office use due to their increased performance and decreased cost of initial acquisition. Such printers range from small inexpensive consumer models to very large and expensive professional machines. However, the major disadvantage to such devices is the cost of replacement ink cartridges, which can greatly offset the lower capital acquisition cost quickly and with only moderate use.

In the worldwide consumer market, four manufacturers account for the majority of inkjet printer sales: Canon®, Hewlett-Packard®, Epson®, and Lexmark®. These printers contain a scanning carriage for supporting one or more disposable print cartridges. Each disposable print cartridge contains a supply of ink in an ink reservoir, a printhead, and ink channels which lead from the ink reservoir to ink ejection chambers formed on the printhead. An ink ejection element, such as a heater resistor or a piezoelectric element, is located within each ink ejection chamber. The ink ejection elements are selectively fired, causing a droplet of ink to be ejected through a nozzle overlying each activated ink ejection chamber so as to print a pattern of dots on the medium. When such printing takes place at 300 dots per inch (dpi) or greater, the individual dots are indistinguishable from one another and high quality characters and images are printed.

Once the initial supply of ink in the ink reservoir is depleted, the print cartridge is disposed of and a new print cartridge is inserted in its place. The printhead, however, has a usable life which outlasts the ink supply. Methods have been proposed to refill these single-use-only print cartridges, but such refilling techniques require penetration into the print cartridge body in a manner not intended by the manufacturer and typically require the user to manually inject the ink into the print cartridge. Additionally, the quality of the refill ink is usually lower than the quality of the original ink. As a result, such refilling frequently results in ink drooling from the nozzles, a messy transfer of ink from the refill kit to the print cartridge reservoir, air pockets forming in the ink channels, poor quality printing resulting from the ink being incompatible with the high speed printing system, and an overall reduction in quality of the printed image.

A search of the prior art did not disclose any patents that read directly on the claims of the instant invention; however, the following references describe methods or apparatus for supplying ink in a bulk manner to lower the cost of delivery.

U.S. Pat. No. 7,089,973 describes a cartridge refilling system in which a retail facility provides commercial refilling services.

U.S. Pat. No. 6,785,483 describes a method of job scheduling in order to extend the life of an ink sump.

U.S. Pat. No. 6,846,071 describes an ink supply apparatus which provides continuous refilling for large-format inkjet printers.

U.S. Pat. No. 6,666,552 describes a check valve and diaphragm arrangement designed for the removal of air in an attempt to extend the time available for storing a quantity of ink.

U.S. Pat. No. 6,565,197 describes an ink jet printer that incorporates a high volume ink reservoir.

U.S. Pat. No. 5,880,748 describes an ink delivery system having an automatic pressure regulating system.

U.S. Pat. No. 5,704,403 describes a device for refilling a printer cartridge of an ink jet printer.

U.S. Pat. No. 5,631,681 describes a system and method for replenishing the ink in ink reservoirs of the printhead cartridges on an inkjet printer.

U.S. Pat. No. 5,367,328 describes an automatic ink refilling system for otherwise disposable inkjet cartridges.

Consequently, there still exists a need for an ink replenishing system that maintains the benefits of existing conventionally available inkjet printers but lowers the overall operating cost of current conventional designs by increasing the bulk ink distribution capacity, thereby allowing per unit savings through 'bulk' pricing.

SUMMARY OF THE INVENTION

It is therefore an object of the present invention to provide an improved ink replenishing system for inkjet printers.

It is another object of the present invention to provide an ink replenishing system that automatically activates the replenishment of modified ink cartridges to receive a refilling volume of ink from a larger, bulk ink source.

Briefly described according to one embodiment of the present invention, the use of one modified tricolor cartridge and one modified black ink cartridge are used to function as the distributors for the proper dispersion of ink. The cartridges are modified to incorporate access orifices to allow communication of ink injectors when the cartridges park (or when the printer is turned off). A micro switch is tripped which, in turn, energizes an isolation relay which powers up the ink replenishing system. A reservoir holding a larger volume of ink, anticipated as being of a pint or larger bulk quantity, is then made available for each color utilized in the system (for example, magenta, cyan and yellow). An additional distributor is available for black ink as well. When the modified cartridges become low, sensing metal plates imbedded in the matrix of the modified cartridges sense little or no current flowing form one plate to the other; thus, there is insufficient current to energize an opposing coil of an electric motor pump relay and the pumping actions is continued until the cartridge is filled to capacity. When full, there is greater current flowing to the opposing coil of the motor pump relay, allowing it to open its contact to the motor pump and stop the pumping action.

The invention is intended to provide a decreased per-page operating cost, as well as a deceased need to replace ink cartridges, both through the use of the distribution of bulk volumes to replenishing ink jet cartridges for inkjet printers.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
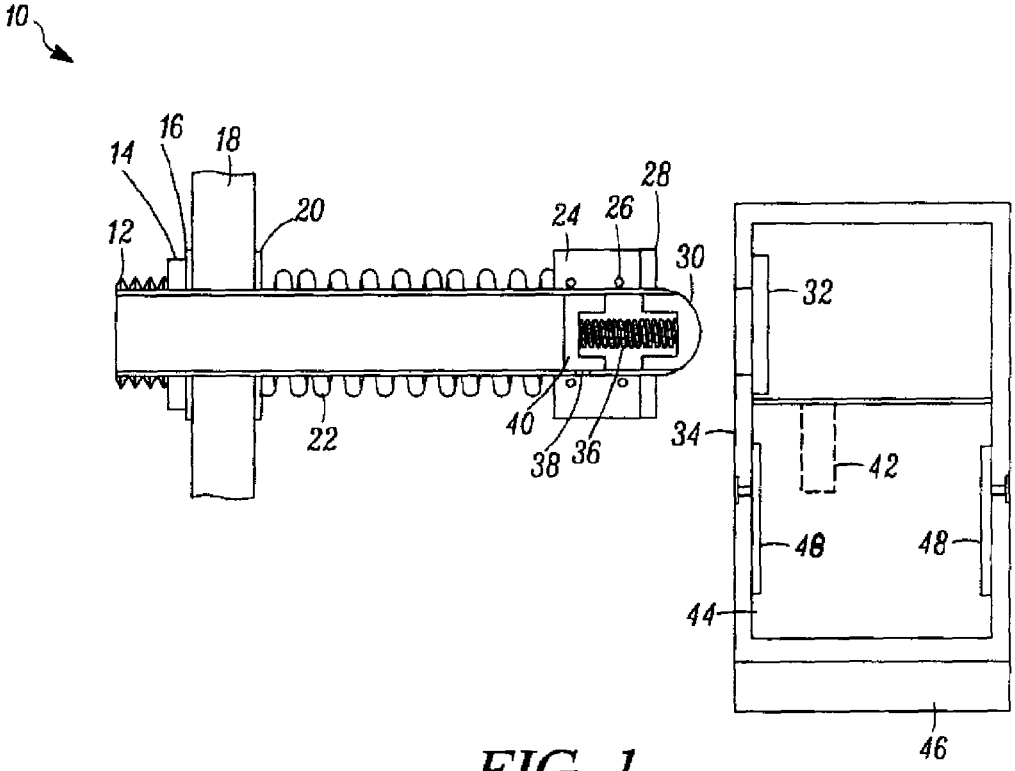
FIG. 1 is a cross sectional schematic of an embodiment of the ink replenishing system for inkjet printers according to the preferred embodiment of the present invention, shown with injector nozzle 12 removed from the ink cartridge 34.
Figure 2:
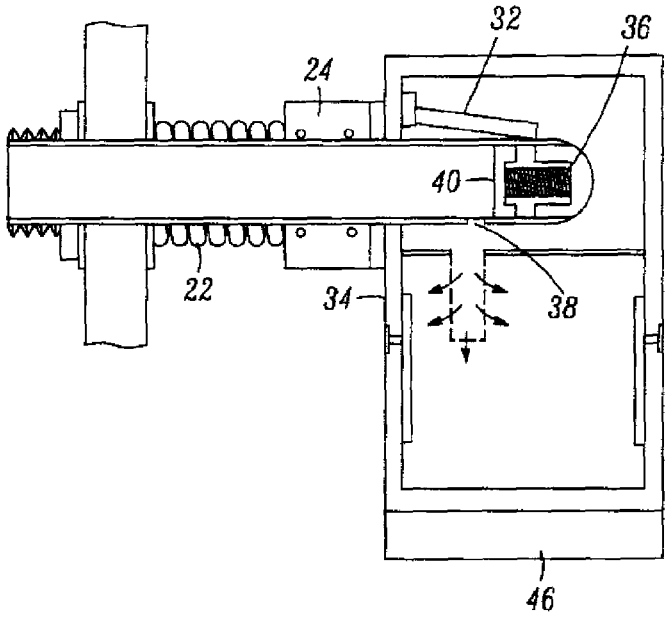
FIG. 2 is an cross sectional schematic thereof shown with injector nozzle 12 inserted into the ink cartridge 34.

Referring now to FIGS. 1-2, an ink replenishing system, generally noted as 10, is shown in its preferred embodiment for replenishing ink for inkjet printers. An ink injector nozzle 12, used to replenish ink to provide distribution of a replenishment volume of ink to the ink cartridge 34.

The injector nozzle 12 is mounted to a supporting bracket 18 through a retaining nut 14 and lock waster 16 being threadingly engaged about the injector nozzle 12 such as to mechanically impinge the nozzle 12 to the bracket 18. A second washer 12 is integral to the injector nozzle 12 and retains the outer end of a spring 22 that provides an urging force to a valve element 40. The valve element 40 is positioned at the distal end of the injector nozzle 12, and mounted slideably on a mounting sleeve 24 about the nozzle 12 such as to move along its length. An end seal 28 seals the nozzle 12 against the ink cartridge 34; a shaft seal 26 further seals the mounting sleeve 24 against the nozzle shaft 12. In this configuration, upon interaction with the injector nozzle 12 with the ink cartridge 34 a fluid communication can be achieved there between and a pressurized seal maintained to prevent leaking of liquid ink.

The ink cartridge 34 incorporates a nozzle portion 46 and forms an internal volume in which a high porosity matrix 44 fills the lower portion of the internal volume and is accessed by a centrally located well 42. The valve 40 is insertable into the ink cartridge 34 by dislocating the hinged cartridge door 32, thereby accessing the internal volume. An valve spring 36, which normally urges the valve body 30 to close the filling orifice 38, is resisted upon insertion of the injector nozzle 12 into the ink cartridge 34, and thereby creates a fluid communication conduit from the injector nozzle to the centrally located well and allows distribution of liquid ink there through in a manner that is described in greater detail below.

Figure 3:
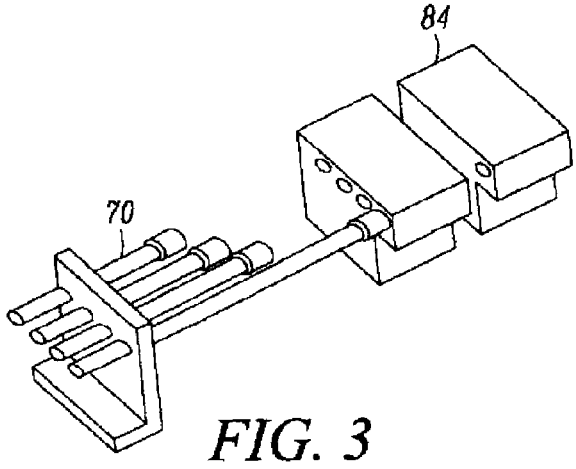
FIG. 3 is a detailed isometric view of the ink injectors 70 shown in relation to tricolor and black ink cartridges 84.
Figure 4:
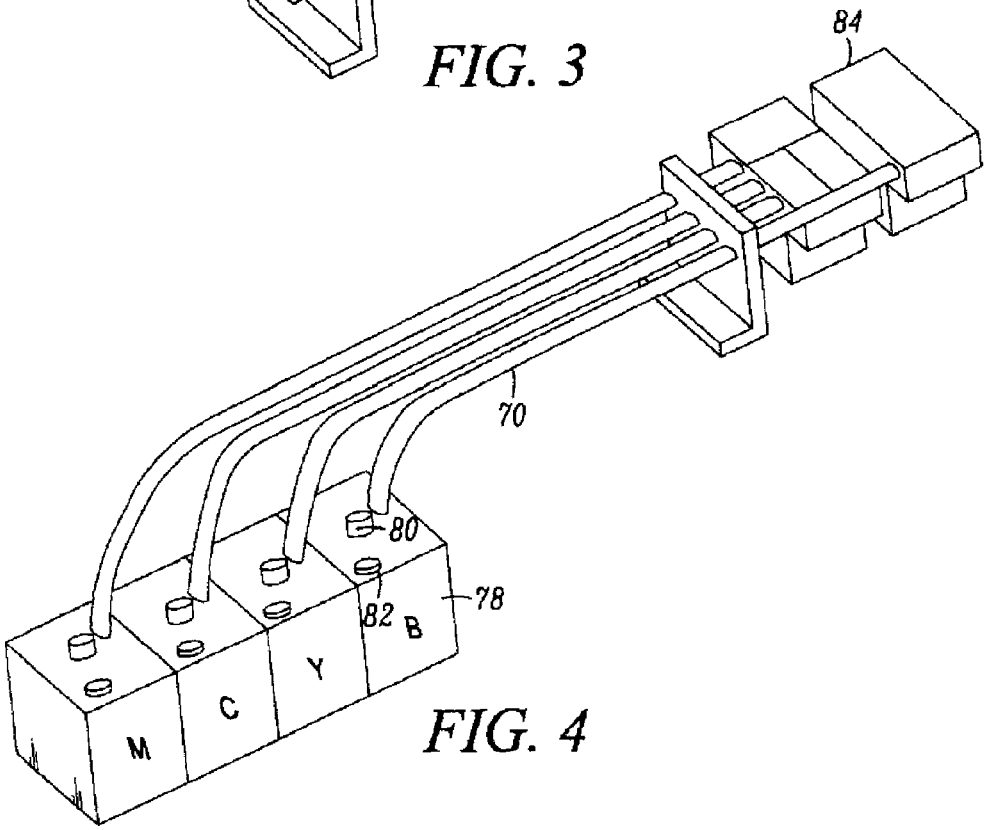
FIG. 4 is an expanded isometric view thereof, shown in relation with the ink reservoirs 78.
Figure 5:
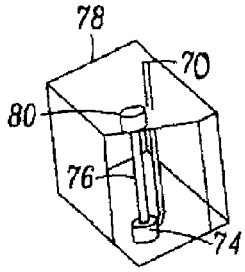
FIG. 5 is an detailed cross sectional perspective view of an ink reservoir 78 for use therewith.

In conjunction with FIGS. 3-5, the ink replenishing system 10 can be shown in better relation with the use of multiple ink reservoirs 78, for various colored inks. As would be obvious to a person having ordinary skill in the relevant art, the use of three colors (magenta "M", cyan "C", and yellow "Y") are generally utilized in conjunction with a separate reservoir for black "B". Each reservoir 78 forms a reservoir filling port and cap assembly 82 to allow for the easy introduction of additional ink, as needed. An electric motor 80 drives a vane pump 74 such that the reservoir volume is urged through the connecting shaft 76 and into the relative ink injector 70 to allow for pressurized distribution of ink from the relevant reservoir 78 to the its associated ink cartridge 84. Note the use of the ink cartridges 84 in relation to the reservoir feed system of FIGS. 3-5 is used for clarity and is intended to represent a number of ink cartridges 34 as shown in detail in FIG. 1-2.

2. Operation of the Preferred Embodiment

Figure 6:
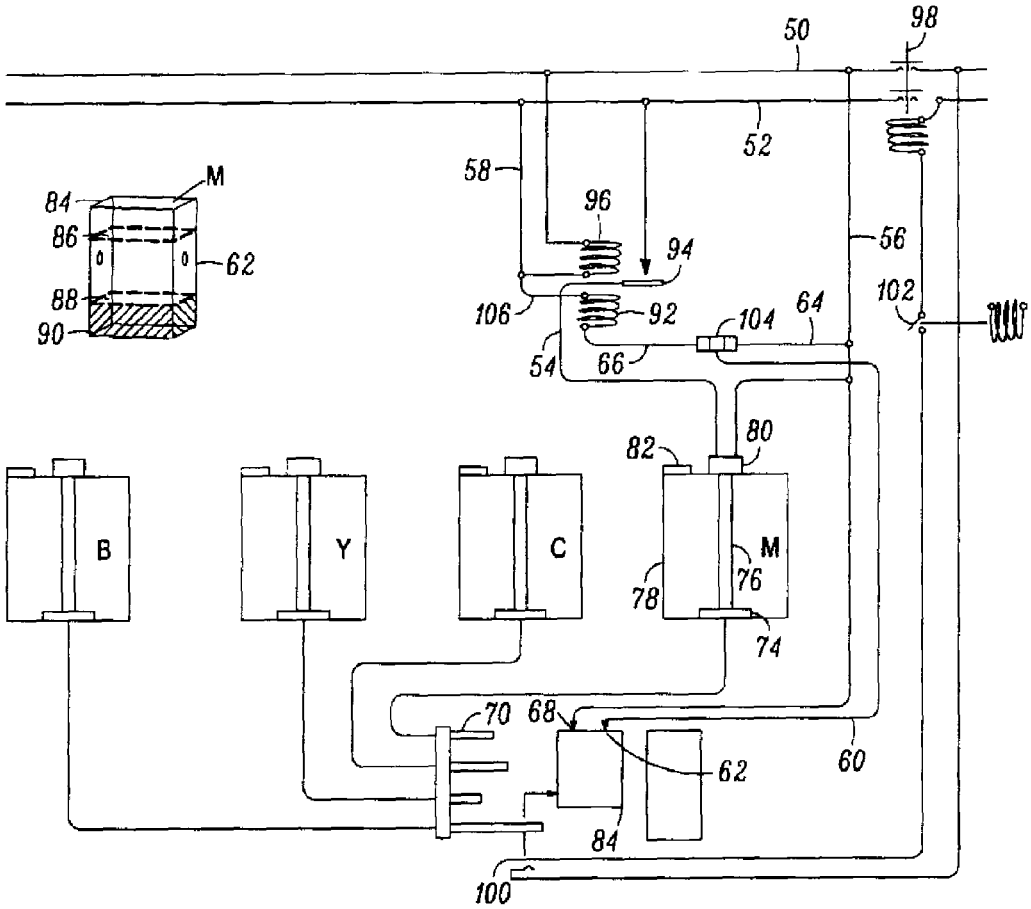
FIG. 6 is a circuit diagram of the ink replenishing system for inkjet printers 10 according to the preferred embodiment of the present invention.

Referring now to FIG. 6 (in conjunction with FIGS. 1-5) the operation of the preferred embodiment of the Ink Replenishing System 10 can be shown according to the present invention. The use of ink reservoirs 78 are used to retain larger volumes of the corresponding inks in order to allow for 'bulk' pricing and reduces changeover. The reservoirs 78 distribute ink to the ink cartridges 84 through ink injectors 70 to distribute ink continually to the ink cartridge 84. The color cartridge has three access orifices to allow three ink injectors to access it when the cartridges parks (when printer is inactive or off). The black cartridges has one injector accessing it from its respective reservoir.

The main electric power line 50 provides power 56 to the motor pump assembly 80 and a contact 68 of a reservoir ink cell. The main electrical power line 50 further powers the coil 96 of relay 106 to engage the line contact 94 (to motor assembly 80). A transistor amplifier 104 provides electrical contact 62 to provide continuity from line 68 through electrically conductive ink within the cartridge to the contact 62. The transistor amplifier 104 further provides standby signal 64 from line 56 and a ready signal 66 from the amplified side of the transistor amplifier 104 to opposing coil 92 of the relay 106.

When a micro switch 100 is tripped, the isolation relay 106 is energized to power up the ink replenishing system. The reservoir 78 containing a relatively larger ink volume (such as, for example, one pint) is then made available for each color utilizing the system. When the ink cartridges 34 become low, a sensing metal plate 48 (FIG. 1) imbedded in the matrix of other cartridges, sense little or no current flowing from one plate to the other, thus providing insufficient current to energize an opposing coil of an electric motor pump relay and the pumping action continues until the cartridge 34 is filled to capacity. At this point, the greater current flow to the opposing coil of the motor pup relay opens it contact to the motor pump and it stops the pumping action. This cycle can continue each time the ink cartridge 34 needs filling.

Figure 7:
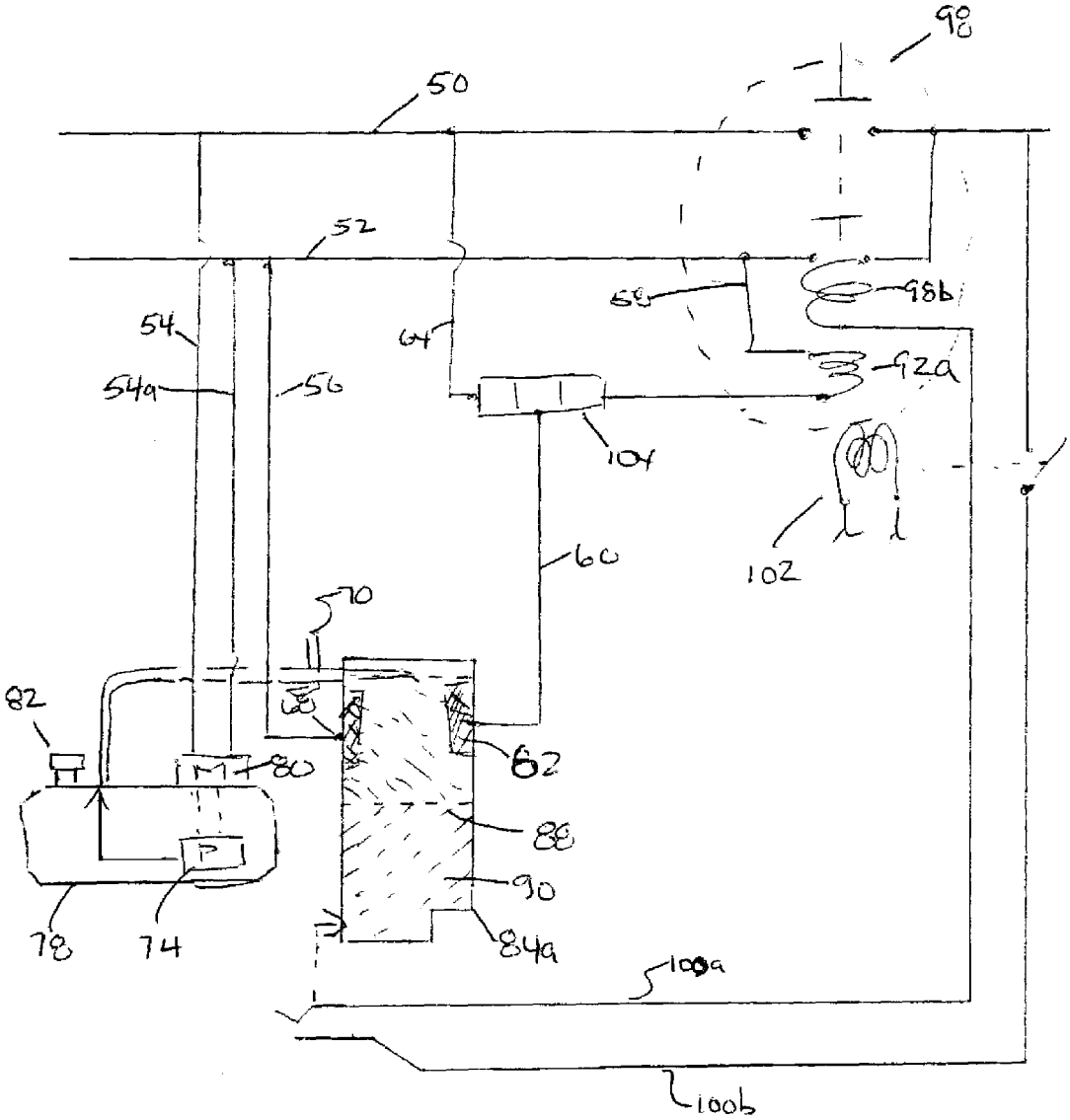
FIG. 7 is a circuit diagram of the ink replenishing system for inkjet printers 10 according to a first alternate embodiment of the present invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. By way of example, and not as a limitation, as shown in FIG. 7 a mechanical latching relay 98 can be used incorporating a mechanical mechanism in replacement of the electrical latching relay 106 (of FIG. 6). In such an embodiment, the mechanical latching relay is initially activated electrically, and its operating coil is then deactivate. However, its work contacts are closed and sustained mechanically in the "ON" position. Continuity is maintained until a second coils of the latching relay is energized by sufficient current form a transistor amplifier, where it unlatches the contacts, and wherein all electric current is removed from the system. Such a configuration assures that a stuck relay does not cause an inadvertent ink spill by a runaway pump.

In greater detail, the isolation relay 98 operates to turn the system ON and OFF. The ON/OFF relay 102 operates to turn the latching relay 98 and shuts down the system 10 and deactivates the microswitch 100. The micro switch 100 within each respective ink cartridge 84 in the parked position closes the micro switch contacts, and power is supplied to the isolation relay coil 98B by access wires 100*a*, 100*b* respectively. With the electrical contacts of the isolation relay 98 closed, electric power is supplied to lines 100*a*, 100*b*, and to the main electrical power lines 50, 52. Because of ink saturation being low within the modified cartridges, pump motor 80 operates to fill them. The needed current to energize a relay 98 cannot occur until current communication is established between the metal plates within the cells of the cartridges. When the volume of any cell is too low on ink, it is automatically saturated to a certain value with ink, causing electric current to flow across the metal plates 48 and through standby lines 56, 60 to energize the transistor amplifier 104. When the transistor-amplifier 104 operates through wires 64, 66, the unlatching coil 92*a* is energized and causes its mechanically closed contacts to open, shutting down the system and rendering the system off.

When any cartridge cells become low of ink due to printer usage, the process automatically begins anew to replenish. As will be obvious to on having ordinary skill in the relevant art, in conjunction with and in light of the present teaching, such an alteration would be entirely equivalent in functionality, and such embodiments herein were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. In an inkjet printer, wherein the improvement comprises an ink delivery system comprising:

a plurality of ink cartridges adapted to form an access orifice for receiving an ink injector conduit, wherein each ink cartridge further comprises a pair of electrically conductive plates spaced apart from a retaining volume for holding a quantity of electrically conductive ink, said ink cartridge and electrically conductive plates thereby forming a micro switch;

each said ink cartridge being adapted to forming an internal volume in which a high porosity matrix fills a lower portion of the internal volume and is accessed by a centrally located well, and wherein a valve insertable into the ink cartridge by dislocating a hinged cartridge door, thereby accessing the internal volume;

a plurality of bolding reservoirs for holding a larger volume of ink, wherein each said reservoir forms a reservoir filling port and cap assembly to allow for the easy introduction of additional ink, as needed;

an electrically operated pump within each holding reservoir thr urging ink from said reservoir through said ink injector conduits;

a valve element positioned at a distal end of an injector nozzle, and mounted slidably on a mounting sleeve about the nozzle such as to move along its length;

an end seal for sealing said nozzle against said ink cartridge upon interaction of the injector nozzle with the ink cartridge in achieving there between and a pressurized seal maintained to prevent leaking of liquid ink; and an ink injector conduit in fluid communication between said ink cartridges and said ink reservoirs, wherein said ink injectors sealingly engage with said ink cartridge when the printer's print head is in a parked position, whereby a filling signal actuates an electric motor pump relay for activating said electrically operated pump and thereby maintain a pumping actions until said respective ink cartridge is filled to capacity;

said ink injector further comprises a valve spring which normally urges the valve body to close the filling orifice, and is resisted upon insertion of the injector nozzle into the ink cartridge and thereby creating a fluid communication conduit from the injector nozzle to the centrally located well and allows distribution of liquid ink there through;

whereby when an ink cartridges become low, said electrically conductive plates sense little or no current flowing from one plate to the other and thereby generates a filling signal;

wherein each said reservoir further comprises:

an electric motor driven vane pump in fluid communication with the reservoir volume and said pump urges reservoir contents in a conventional pumping manner through a connecting shaft and into the relative ink injector to allow for pressurized distribution of ink from the relevant reservoir to the its associated ink cartridge.

* * * * *